United States Patent [19]

Marshall

[11] Patent Number: 4,874,663

[45] Date of Patent: Oct. 17, 1989

[54] OVERFINISH FOR ABRASION RESISTANT ZERO TWIST FABRIC

[75] Inventor: Robert M. Marshall, Chesterfield, Va.

[73] Assignee: Allied-Signal Inc., Morris Township, Morris County, N.J.

[21] Appl. No.: 124,202

[22] Filed: Nov. 23, 1987

[51] Int. Cl.[4] ..... B32B 27/02; B32B 33/00; D06M 13/18; D06M 15/53

[52] U.S. Cl. ..... 428/272; 8/115.6; 252/8.7; 427/394; 428/395; 428/908.8

[58] Field of Search ..... 8/115.6; 252/8.7; 427/394; 428/272, 908.8, 395

[56] References Cited

U.S. PATENT DOCUMENTS

| | | | |
|---|---|---|---|
| 3,416,952 | 12/1968 | McIntyre et al. | 428/482 |
| 3,557,039 | 1/1971 | McIntyre et al. | 524/605 |
| 4,110,227 | 8/1978 | Dudley et al. | 252/8.9 |
| 4,127,490 | 11/1978 | Newkirk et al. | 252/8.9 |
| 4,330,588 | 5/1982 | Larson et al. | 428/264 |
| 4,351,738 | 9/1982 | Takahashi et al. | 252/8.75 |
| 4,800,117 | 1/1989 | Marshall | 428/395 |

*Primary Examiner*—James C. Cannon

[57] ABSTRACT

Abrasion resistant fabric can be woven from substantially untwisted polyester or polyamide yarn and treated with an overfinish composition to give enhanced abrasion resistance. The overfinish composition comprises effective amounts of a specified crystallizable copolymer consisting essentially of linear polyethylene terephthalate segments and polyoxyethylene terephthalate segments, a specified polyethyleneglycol ester or alcohol, and sodium dialkylnaphthalene.

14 Claims, No Drawings

OVERFINISH FOR ABRASION RESISTANT ZERO TWIST FABRIC

BACKGROUND OF THE INVENTION

The invention relates to improved multifilament synthetic yarns with improved abrasion resistance. More specifically, a novel aqueous overfinish composition applied to a fabric woven from substantially untwisted synthetic multifilament yarn provides a fabric which, when heated sufficiently, retains required resistance to abrasion.

Narrow-woven fabrics are considered to be those fabrics manufactured to less than 12 inches in width and having woven or fastened-in selvages. Such fabrics are commonly woven on special narrow fabric looms or on needle looms that fabricate a number of tapes at the same time. End uses for narrow fabrics include automotive and aircraft seat belts, as well as many other applications including parachute harnesses, cargo slings, furniture tapes, elastic tapes, aircraft arrestor tapes and animal control webbings such as horse halters and dog collars.

Synthetic yarns including polyester and nylon yarns are used in these applications. Important physical property requirements for such applications include low elongation properties, excellent strength, good mechanical qualities such as abrasion resistance, good dyeing characteristics, and good light stability. The yarn must possess good weaving characteristics so that acceptable fabric is woven without undue picks from broken filaments.

Fiber finishes can be applied to the yarn to provide such necessary weaving characteristics, including necessary control of static, friction, and cohesiveness of filaments required for the weaving process. Additionally, the multifilament yarn is usually subjected to a twisting operation prior to weaving to provide necessary resistance to abrasion for the finished fabric.

Applicant has discovered that by applying a novel fiber finish to the surface of narrow-woven fabric woven from substantially untwisted yarn there is provided an important cost savings benefit, and the resulting fabric still possesses required resistance to abrasion.

SUMMARY OF THE INVENTION

Abrasion resistant fabric can be woven from substantially untwisted polyester or polyamide yarn and treated with an overfinish composition to give enhanced abrasion resistance. The overfinish composition is an aqueous dispersion comprising effective amounts of (a) a crystallizable copolymer consisting essentially of 10 to 50 percent by weight linear polyethylene terephthalate segments having sufficient ethylene terephthalate units to confer crystallinity on the compound and 50 to 90 percent by weight polyoxyethylene terephthalate segments having an average molecular weight of 1000 to 4000, the molar ratio of polyethylene terephthalate to polyoxyethylene terephthalate being from 2:1 to 6:1, the viscosity ratio of the copolymer being between 1.10 and 1.50, and the melting point measured by the temperature of disappearance of birefrigence being above 100° C.;

(b) a compound selected from the group consisting of a polyethyleneglycol ester formed by reacting a $C_6$ to $C_{22}$ fatty acid with ethylene oxide, such that polyoxyethylene segments within the reaction product have an average molecular weight of 200 to 1000, and a polyethyleneglycol ether formed by reacting a $C_6$ to $C_{22}$ fatty alcohol with ethylene oxide, such that polyoxyethylene segments within the reaction product have an average molecular weight of 200 to 1000; and (c) a compound selected from the group consisting of sodium dialkylnaphthalene sulfonate and potassium dialkylnaphthalene sulfonate.

The abrasion resistant fabric, the method for production thereof, the yarn finish composition and the treated fiber are considered to be within the scope of the invention.

DESCRIPTION OF THE PREFERRED EMBODIMENT

Effective amounts of (a) a crystallizable copolymer consisting essentially of 10 to 50 percent by weight linear polyethylene terephthalate segments having sufficient ethylene terephthalate units to confer crystallinity on the compound and 50 to 90 percent by weight polyoxyethylene terephthalate segments having an average molecular weight of 1000 to 4000, the molar ratio of polyethylene terephthalate to polyoxyethylene terephthalate being from 2:1 to 6:1, the viscosity ratio of the copolymer being between 1.10 and 1.50, and the melting point measured by the temperature of disappearance of birefrigence being above 100° C.; (b) a compound selected from the group consisting of a polyethyleneglycol ester formed by reacting a $C_6$ to $C_{22}$ fatty acid with ethylene oxide, such that polyoxyethylene segments within the reaction product have an average molecular weight of 200 to 1000, and a polyethyleneglycol ether formed by reacting a $C_6$ to $C_{22}$ fatty alcohol with ethylene oxide, such that polyoxyethylene segments within the reaction product have an average molecular weight of 200 to 1000; and (c) a compound selected from the group consisting of sodium dialkylnaphthalene sulfonate and potassium dialkylnaphthalene sulfonate in a fiber finish composition applied to a fabric woven from substantially untwisted polyester or polyamide yarn and heated sufficiently to provide a durable surface treatment yields a fabric which offers required abrasion resistance important for many narrow woven fabric applications such as seat belts for automotive and aircraft applications.

The preparation of the crystallizable copolymer (a) and treatment of polyester fiber is described in U.S. Pat. No. 3,557,039 to McIntyre et al., issued Jan. 19, 1971, and incorporated herein by reference. A commercially available material suitable for the invention is Milease T available from ICI, an aqueous dispersion containing about 15 weight percent of polymeric constituent.

For constituent (b) a polyethyleneglycol (PEG) ester or ether is formed by reacting a $C_6$ to $C_{22}$ fatty acid or alcohol with ethylene oxide (EO), such that the polyoxyethylene (POE) segments within the reaction product have an average molecular weight of 200 to 1000. Preferred is a PEG ester formed by reacting a $C_8$ to $C_{12}$ fatty acid with ethylene oxide such that polyoxyethylene segments within the reaction product have an average molecular weight of 300 to 600. An exemplary material is polyoxyethylene (400) pelargonate, available as Ethox 1122 from Ethox Chemicals. POE (400) means 9 moles of EO have been reacted per unit of fatty acid, giving an average molecular weight of about 400.

for constituent (c), sodium or potassium dialkyl naphthalene sulfonate can be utilized, with sodium dimethyl naphthalene sulfonate an exemplary material. This is commercially available as Petro AG from Petrochemicals Company, Inc.

The constituents are combined with water to form an aqueous dispersion suitable for application to the fabric. Recommended levels for the aqueous dispersion include from 0.5 to 3.0 weight percent of (a), from 0.1 to 10 weight percent of (b), and from 0.05 to 1.0 weight percent (c).

The blended overfinish is preferably applied to the narrow-woven fabric made from substantially untwisted yarn. By substantially untwisted, it is meant that the yarn has not been subjected to a separate twisting operation, though there may be some degree of entanglement such as that provided by on-line entanglement jets. This permits elimination of the twisting operation prior to weaving, and thus results in important economic savings. For example, while the manufacture of polyester seat belt material with untwisted yarn provides a substantial cost savings, belts made in this manner do not pass required hex bar and buckle abrasion tests.

Such abrasion tests have been set forth as standard tests in U.S. Motor Vehicle Standard Specification (MVSS) 571.209 for Seat Belt Assemblies, including S 4.2d Resistance to hexbar and buckle abrasion and S 4.3f tilt-lock adjustment (buckle slip). Individual auto maker's specifications are similar to MVSS 209, but may be more stringent.

To produce a durable surface treatment, it is essential to heat the solids of the overfinish in contact with the fabric. The dispersion is applied to the narrow-woven fabric in an amount to provide at least 0.3 weight percent of solids on the fabric. The continuous phase water may be removed by the same or by a previous thermal treatment or may be allowed to evaporate before thermal treatment. The overfinish is conveniently applied subsequent to dyeing operations. The temperature required to produce a durable surface treatment is at least 90° C., preferably higher, with care taken not to damage or melt the fabric. Polyester seat belt fabric, for example, can be treated after dyeing by dipping the fabric into a bath containing the overfinish then heating the coated fabric to at least 100° C. for a period of at least 1.5 minutes. Higher temperatures will be effective for shorter time periods.

Seat belting is generally woven in a two-up, 2-down herringbone twill. This weave helps to provide a relatively thin, narrow fabric having low elongation, high strength and good abrasion resistance. The dyeing and finishing process are in important part of seat belt production since the final belting must be resistant to fading by exposure to sunlight and the dyestuff must not fade or rub off even when the seat belt is wet. Seat belts are typically dyed with disperse dyestuffs in a continuous process which requires the use of heat. The heat utilized in the dyeing process to fix the dye into the fiber is advantageously used to heat set the overfinish constituents subsequent to dyeing. Thus an efficient, process for the production of narrow woven fabric is made possible wherein the substantially untwisted yarn can be woven directly into a narrow woven, zero-twist fabric and the final fabric coated with the constituents of this invention and heat treated to provide the resistance to abrasion essential for this application.

EXAMPLE 1

For this example 840 denier 70 filament polyethylene terephthalate yarn commercially available from Allied-Signal Inc. as Type 1W70 polyester was utilized.

Seat belt webbing was prepared from the yarn by a zero twist technique whereby 528 ends were fed directly into the loom without twisting and woven at 17 picks per inch for filling.

The belting was dyed with disperse dyestuffs in a continuous thermosol/hot air process, which includes the step of passing dried webbing through a thermosol oven for about two minutes at 190° to 220° C. Samples were prepared by padding onto belting each of the overfinishes given in Table I, then drying the coated samples 15 minutes at 250° F. (120° C.). Finish was applied at a standard wet pick-up of about 17 weight percent of the overfinish, based on weight of the belting.

The treated belting was tested for resistance to hex bar and buckle abrasion in accordance with MVSS 571.209 S 4.2d by dragging a portion of the belt through a seat belt buckle 5000 times (2500 cycles). Breaking strength of the abraded belts was compared to breaking strength of the original unabraded belt. Results are reported in percent breaking strength retained. In accordance with MVSS 571.209 S 4.3f for tilt-lock adjustment, the treated belting was tested for buckle slip. Results are reported in pounds at which slippage occurred. Specifications require a result in excess of 8000 pounds.

TABLE I

| Sample | Overfinish | Breaking Strength Retention % | Buckle Slip, lb |
|---|---|---|---|
| A | 10% Milease T[1] | 91 | 4400 |
| B | 7.5% Milease T[1] | 94 | 4400 |
| C | 5% Milease T[1] | 74 | 5600/ 8400 |
| D | 8% Milease T[1], 2% Repallan 80[2] | 94 | 5000/ 6000 |
| E | 10% Milease T[1], 1% Ludox HS-30[3] | 71 | 6100 |
| F | 7.5% Milease T[1], 2% Ucon 50HB260[4] | 95 | 5900/ 9000 |
| G | 5% Milease T[1], 5% Chemowax 50s[5] | 95 | 5900/ 9000 |
| H | 7.5% Milease T[1], 25% Burco NF[6] | 98 | 6400/ 6900 |
| I | 5.0% Milease T[1], 5% Repelotex 100[7] | 88 | 6100 |
| J | 5% Milease T[1], 5% Milease HPA[8] | 66 | 7800 |
| K | 4% Eastman WD[9] | 42 | 9000+ |
| L | 4% Stypol 40[10] | 44 | 9000+ |
| M | 7.5% Milease T, 2.5% Eastman WD | 57 | 7600 |
| N | 10% Milease T, 2% Nitrile 1571[11] | 89 | 5700/ 5900 |
| O | 10% Milease T, 1% UE 40408[12] | 85 | 4700 |
| P | 10% Milease T, 1% Oleate Soap[13] | 90 | 4700 |
| Q | 10% Milease T | 90 | 5400 |
| R | 10% Milease T, 1% Ethox 1122 | 91 | 6900/ 9000 |
| S | 10% Milease T, 0.5% Petro AG | 85 | 9000+ |
| T | 10% Milease T, 3% Ethox 1122, | 95 | 9000+ |

TABLE I-continued

| Sample | Overfinish | Breaking Strength Retention % | Buckle Slip, lb |
|---|---|---|---|
| | 0.25% Petro AG | | |

Footnotes:
[1]15% solids, aqueous dispersion of crystallizable copolymer within constituent (a) of invention.
[2]polymeric silicone water repellant resin available from Henkel Corporation.
[3]an aqueous dispersion of silicon dioxide available from DuPont.
[4]an ethylene oxide/propylene oxide adduct on butyl alcohol available from Union Carbide.
[5]an emulsion of paraffin wax available from Chematron.
[6]15% solids, aqueous dispersion of crystallizable copolymer within constituent (a) of invention available from Burlington Chemicals.
[7]a polyamide wax emulsion available from Lyndal Chemicals.
[8]15% solids, anionic aqueous dispersion of crystallizable copolymer within constituent (a) of invention available from ICI.
[9]a polyester resin dispersion available from Eastman Kodak.
[10]a high molecular weight polyester dispersion available from Freeman Chemical.
[11]synthetic rubber dispersion available from B. F. Goodrich.
[12]a urethane resin dispersion available from Permuthane, Inc.
[13]potassium oleate available from Ethox Chemical.

For the data in Table I, samples A, B, C, and Q show results for constituent (a) only. Samples D-J, and M-S show constituent (a) blended with other materials. Samples K and L are materials different from constituent (a). Sample R shows constituent (a) with constituent (b). Sample S shows constituent (a) with constituent (c). Sample T shows results for the claimed invention which includes constituents (a), (b), and (c). It is shown that Sample T provides a high level of retained breaking strength and buckle slippage in excess of specifications.

EXAMPLE 2

Additional plant trials were conducted wherein overfinishes were applied to zero twist seat belt webbing subsequent to dyeing and then heated to 250° F. (120° C.) for two minutes. The belting was tested for web abrasion and buckle slip as in Example 1. In addition, tests were made for web abrasion by dragging a portion of belt across a hex bar 5000 times, with the results reported in retained breaking strength.

| Trial | Overfinish | Buckle Breaking Strength Retention, % | Buckle Slip, lb | Hex Bar Breaking Strength Retention, % |
|---|---|---|---|---|
| 1 | 10% Milease T<br>0.25% Petro AG | 85 | 7100<br>7300<br>7100<br>7600 | 88 |
| 2 | 3% Milease T<br>3% Ethox 1122 | 82 | 4500 | 80 |
| 3 | 5% Milease T<br>3% Ethox 1122<br>0.5% Petro AG | 95 | 9000+ | 91 |

Again, it is shown that the three constituents together provide required resistance to abrasion and buckle slip resistance.

What is claimed:

1. Abrasion resistant fabric woven from synthetic fiber selected from the group consisting of polyester and polyamide, the fabric having been woven from substantially untwisted yarn and treated with an overfinish composition in an amount sufficient to give enhanced abrasion resistance to the fabric, the overfinish composition comprising an aqueous dispersion containing effective amounts of (a) a crystallizable copolymer consisting essentially of 10 to 50 percent by weight linear polyethylene terephthalate segments having sufficient ethylene terephthalate units to confer crystallinity on the compound and 50 to 90 percent by weight polyoxyethylene terephthalate segments having an average molecular weight of 1000 to 4000, the molar ratio of polyethylene terephthalate to polyoxyethylene terephthalate being from 2:1 to 6:1, the viscosity ratio of the copolymer being between 1.10 and 1.50, and the melting point measured by the temperature of disappearance of birefringence being above 100° C.;

(b) a compound selected from the group consisting of a polyethyleneglycol ester formed by reacting a $C_6$ to $C_{22}$ fatty acid with ethylene oxide, such that polyoxyethylene segments within the reaction product have an average molecular weight of 200 to 1000, and a polyethyleneglycol ether formed by reacting a $C_6$ to $C_{22}$ fatty alcohol with ethylene oxide, such that polyoxyethylene segments within the reaction product have an average molecular weight of 200 to 1000; and (c) a compound selected from the group consisting of sodium dialkylnaphthalene sulfonate and potassium dialkylnaphthalene sulfonate.

2. The fabric of claim 1 wherein the aqueous dispersion comprises from 0.5 to 3.0 weight percent of (a), from 0.1 to 10 weight percent of (b), and from 0.05 to 1.0 weight percent of (c).

3. The fabric of claim 1 which is polyester.

4. The fabric of claim 3 wherein (b) is a polyethyleneglycol ester formed by reacting a $C_8$ to $C_{12}$ fatty acid with ethylene oxide such that polyoxyethylene segments within the reaction product have an average molecular weight of 300 to 600.

5. The fabric of claim 4 wherein (b) is polyoxyethylene (400) pelargonate.

6. The fabric of claim 5 wherein (c) is sodium dimethylnaphthalene sulfonate.

7. The fabric of claim 6 wherein the aqueous dispersion comprises from 0.5 to 3.0 weight percent of (a), from 0.1 to 10 weight percent of (b), and from 0.05 to 1.0 weight percent of (c).

8. A method for producing abrasion resistant fabric, said method comprising weaving said fabric from substantially untwisted yarn selected from the group consisting of polyester and polyamide and applying to said woven fabric and heating sufficiently an overfinish composition in an amount sufficient to give enhanced abrasion resistance, the overfinish composition comprising an aqueous dispersion containing effective amounts of (a) a crystallizable copolymer consisting essentially of 10 to 50 percent by weight linear polyethylene terephthalate segments having sufficient ethylene terephthalate units to confer crystallinity on the compound and 50 to 90 percent by weight polyoxyethylene terephthalate segments having an average molecular weight of 1000 to 4000, the molar ratio of polyethylene terephthalate to polyoxyethylene terephthalate being from 2:1 to 6:1, the viscosity ratio of the copolymer being between 1.10 and 1.50, and the melting point measured by the temperature of disappearance of birefringence being above 100° C.;

(b) a compound selected from the group consisting of a polyethyleneglycol ester formed by reacting a $C_6$ to $C_{22}$ fatty acid with ethylene oxide, such that polyoxyethylene segments within the reaction product have an average molecular weight of 200 to 1000, and a polyethyleneglycol ether formed by reacting a $C_6$ to $C_{22}$ fatty alcohol with ethylene oxide, such that polyoxyethylene segments within the reaction product have an average molecular weight of 200 to 1000; and (c) a compound selected from the group consisting of sodium dialkylnaphthalene sulfonate and potassium dialkylnaphthalene sulfonate;

then heating sufficiently to produce a durable surface treatment.

9. The method of claim 8 wherein said fabric is woven from substantially untwisted polyester yarn.

10. The method of claim 9 wherein (b) is a polyethyleneglycol ester formed by reacting a $C_8$ to $C_{12}$ fatty acid with ethylene oxide such that polyoxyethylene segments within the reaction product have an average molecular weight of 300 to 600.

11. The method of claim 10 wherein (b) is polyoxyethylene (400) pelargonate.

12. The method of claim 11 wherein (c) is sodium dimethylnaphthalene sulfonate.

13. The method of claim 12 wherein the aqueous dispersion comprises from 0.5 to 3.0 weight percent of (a), from 0.1 to 10 weight percent of (b), and from 0.05 to 1.0 weight percent of (c).

14. The method of claim 13 wherein the woven fabric with applied overfinish composition is heated at a temperature of at least 100° C. for a period of at least 1.5 minutes.

* * * * *